United States Patent [19]

Czerwinski

[11] 4,239,943

[45] Dec. 16, 1980

[54] ADJUSTABLE DUAL SPIDER FOR A LOUDSPEAKER

[75] Inventor: Eugene J. Czerwinski, Studio City, Calif.

[73] Assignee: Cerwin Vega, Inc., Arleta, Calif.

[21] Appl. No.: 4,591

[22] Filed: Jan. 18, 1979

Related U.S. Application Data

[63] Continuation of Ser. No. 852,219, Nov. 17, 1977, abandoned.

[51] Int. Cl.[3] ..... H04R 9/04

[52] U.S. Cl. ..... 179/115.5 VC; 179/180

[58] Field of Search ..... 179/115.5 VC, 115.5 ES, 179/115.5 R, 181 R, 180

[56] References Cited

U.S. PATENT DOCUMENTS

| | | | |
|---|---|---|---|
| 1,540,585 | 6/1925 | Abbott | 179/181 R X |
| 2,002,189 | 5/1935 | Round et al. | 181/171 |
| 2,147,605 | 2/1939 | Lissauer | 179/115.5 VC |
| 2,997,549 | 8/1961 | Hassan | 179/115.5 VC |

FOREIGN PATENT DOCUMENTS

| | | | |
|---|---|---|---|
| 30070 | 1/1926 | France | 179/181 R |
| 271604 | 6/1927 | United Kingdom | 179/115.5 ES |
| 314715 | 7/1929 | United Kingdom | 179/115.5 VC |
| 513268 | 10/1939 | United Kingdom | 179/115.5 VC |

OTHER PUBLICATIONS

*Hi-Fi Loudspeakers & Enclosures,* by A. B. Cohen, pp. 21-23, John F. Rider Publisher, Inc., New York, 1956.

*Primary Examiner*—Thomas W. Brown
*Attorney, Agent, or Firm*—W. Edward Johansen

[57] ABSTRACT

The present invention is an internal stabilizing spider-dust cap for use in combination with a loudspeaker that has an external centering spider and a surround mechanically coupling the conically shaped diaphragm of the loudspeaker to the frame thereof. The loudspeaker includes a ring-shaped magnet, a pole piece, gap plate, and a pole plate of iron which are separated by a cylindrical voice coil member and a voice coil, which is disposed about the voice coil member, and which provides a magnetic gap for the voice coil. The centering spider aligns the voice coil within the magnetic gap. The stabilizing spider is mechanically coupled to the internal sidewall of the conically shaped diaphragm and to a rod which is disposed perpendicular into the pole piece. The center of the stabilizing spider is mechanically clamped to the rod by a mounting device which is secured in place by a set screw in one embodiment so that it may be raised and lowered in order to modify bias compliance linearity of the existing suspension. A lateral adjustment may also be provided to increase effective excursion and to correct for faulty assembly.

2 Claims, 9 Drawing Figures

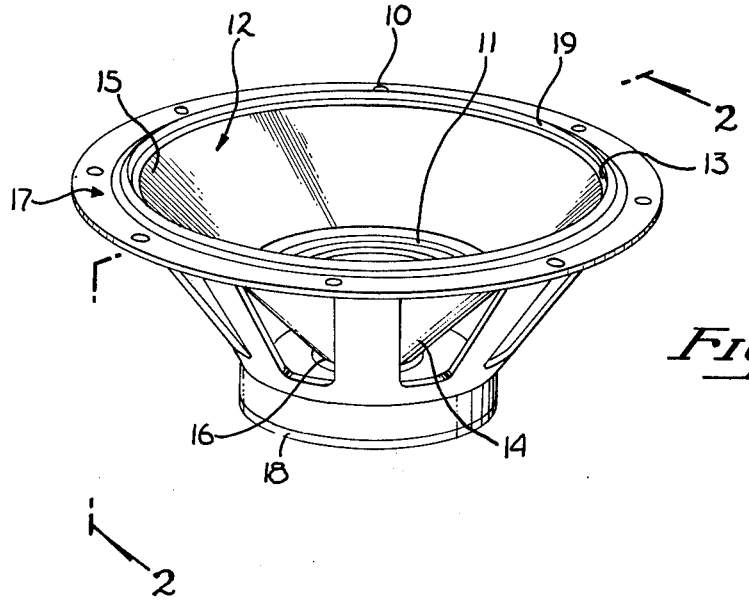
Fig. 1
Fig. 2
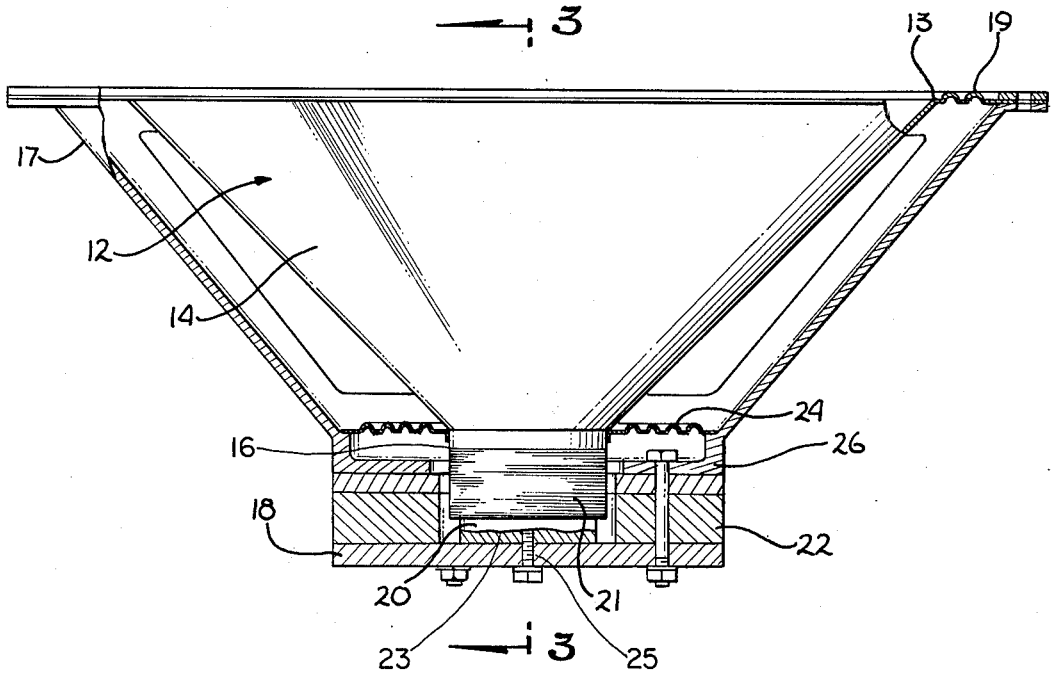

Fig. 6
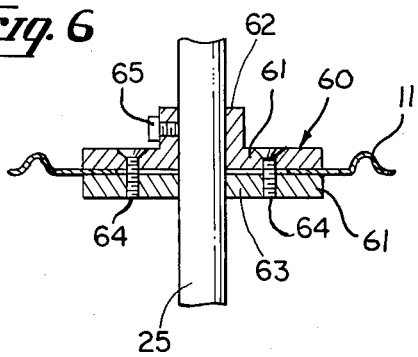
Fig. 7
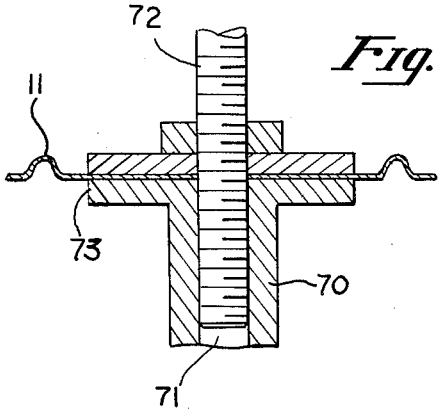
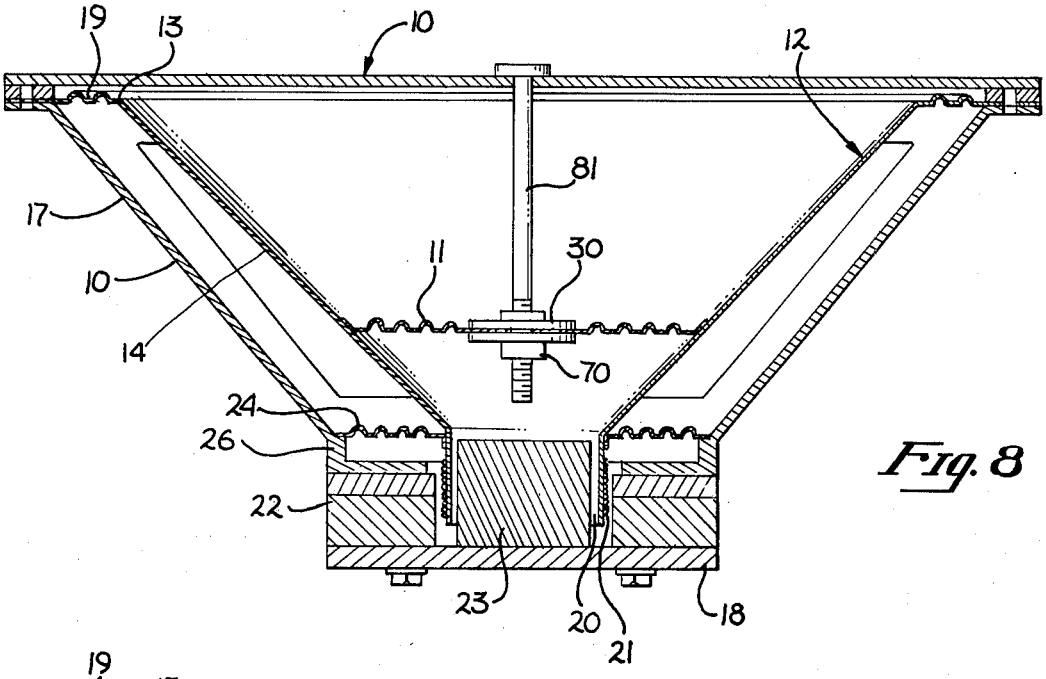
Fig. 8
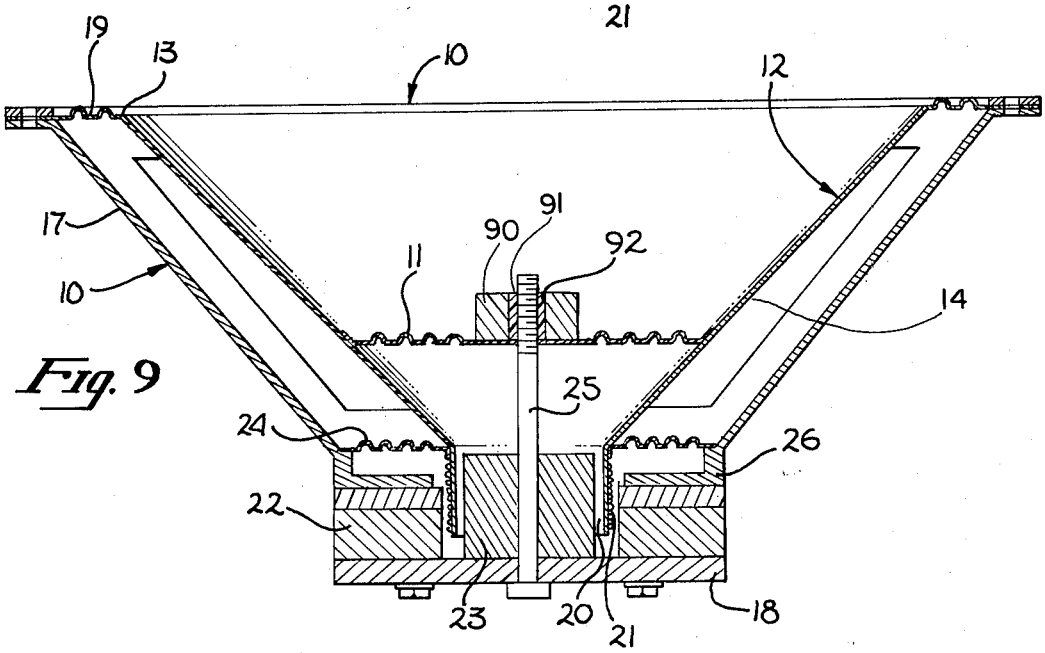
Fig. 9

ADJUSTABLE DUAL SPIDER FOR A LOUDSPEAKER

This is a continuation of application Ser. No. 852,219, filed Nov. 17, 1977, now abandoned.

BACKGROUND OF THE INVENTION

1. Field of the Invention

The present invention relates to loudspeakers and more particularly to dual spider arrangements for use in combination with the loudspeakers.

2. Description of the Prior Art

U.S. Pat. No. 2,812,825, entitled Loud Speaker Diaphragm Supporting Member, issued Charles L. Matthews on Nov. 12, 1957, teaches a member for supporting a moving coil in an electro-acoustical transducer and for centering such coil in an air gap in such transducer. The member includes a corrugated disc of resin-impregnated, thin, resilient, porous cotton fabric and an external film of modified polyvinyl chloride type resin on the surface of the disc to fill the pores in the cotton.

U.S. Pat. No. 2,641,329, entitled Loudspeaker Diaphragm with Transversely Arched Stiffener Means, issued to Sidney E. Levy and Abraham B. Cohen on June 9, 1953 teaches an acoustic diaphragm for loudspeakers, that include an acoustical energy-responsive diaphragm member of substantially conical form having a relatively rigid transversely arched stiffener member secured at its outer marginal edge to an intermediate portion of the diaphragm member and extending across the latter. The stiffener member has a plurality of relatively small sound-radiating perforations therethrough, the perforations of the stiffener member being spaced from each other and each perforation having its axis inclined at an angle to the central axis of the diaphragm member. The perforated stiffener member has the property of directional control of high frequency propagation generated from the center of the diaphragm member.

U.S. Pat. No. 3,905,448, entitled Loudspeaker, issued to Hirotake Kawakami, Toshio Sasabe, Toshio Hirosawa, Nobuyaki Arakawa, Kozo Kokubu, Kazumasa Abe and Toshiko Harashino, on Sept. 16, 1975 teaches a loudspeaker with a suspension device for supporting the diaphragm from its frame. In the loudspeaker, the upper part and the lower part of a cone-shaped diaphragm with a voice coil are suspended from a frame by a ring-shaped suspension member, herein referred to as a first suspension means, and by a ring-shaped suspension member, herein referred to as a suspension means, respectively. At least one of the suspension means is formed of a mixture of elastic material such as rubber, with carbon fibers therein. The fibers are needle-like and are aligned radially in the material of at least one of the suspension means.

U.S. Pat. No. 3,767,004, entitled loudspeaker, issued to Arthur Liebscher on Oct. 23, 1973, teaches a loudspeaker that is provided in which a thin surround is employed for the speaker cone of impervious foam material, the surround being characterized by omnidirectional elastic tension and being secured between the cone and the support.

The loudspeaker also has a pair of spaced coaxial supports which support the coil. The supports have radial rigidity and high axial flexibility so that the surround serves no supporting function and acts primarily as an air separator at the periphery of the diaphragm.

Abraham B. Cohen has written an article entitled, The Mechanics of Good Loudspeaker Design, published in Volume 2, Number 3, July, 1954, Journal of the Audio Engineering Society on pages 176 to 182. In his article he discusses a double spider to correct voice coil misalignment as follows:

"Having thus dealt briefly with one of the unrecognized causes of gap and voice coil misalignment, we must complete the study of the problem by considering the more commonly recognized cause of such misalignment. Damaging eccentric and rocking motion of the voice coil about its axis of motion will occur while it is vibrating, if the means used to maintain accuracy of such motion are inadequate to meet the mechanical requirements imposed on the system by the large power output expected of it. The usual means for preventing such side swaying of the voice coil motion is the well-known spider located directly at the voice coil area. There is a new and exceedingly successful solution to the problem of maintaining precision voice coil alignment during vibration. Placement of two axially spaced spiders at the apex area of the vibrating system provides a dual guide to the vibrating system that keeps the voice coil motion rigidly channeled along one line of vibration that neither deviates in angular direction from the central axis nor becomes eccentrically located in respect to this axis."

In his book, *Hi-Fi Loudspeakers and Enclosures,* 2nd Edition, Abraham B. Cohen further describes a dual spider arrangement on pages 87 to 88 in which he states:

"The mechanical precision with which the suspension holds the whole assembly together determines the mechanical longevity of the voice coil itself. The voice coil must be kept perfectly aligned mechanically in its magnetic gap at all times during its vibration cycle. If, during its vibration, it sways or twists sideways, it may scrape itself against the walls of the gap, causing rubbing of the voice coil, which in turn results in distortion, in shorted turns, and sooner or later, in an open voice coil. Although the spider is normally the device that keeps the coil centered in the gap when no motion is involved it is the combination of the spider and the other cone suspension that dictates how the coil behaves in the gap under motion. Obviously, even though the spider may keep the coil centered, if the cone tilts, it will tilt the coil and cause rubbing. Where small motions are involved, as in tweeters, this condition does not present a problem. However, in the case of woofers, where voice coil motions of the order of $\frac{3}{8}$ inch or more are prevalent, added insurance against voice coil misalignment may be had by the double spider suspension. The addition of the second stabilizing spider part way up the cone of the speaker acts as a second guide to the linear in and out motion of the voice coil, keeping the voice coil not only rigidly centered, but also moving in a rigidly prescribed axis."

"In loudspeakers in which the voice coil travels a straight and narrow path, and in which the side play of the coil is rigidly controlled, the clearances between the overall gap walls and the voice coil may be reduced, with resultant improved magnetic circuit efficiency, because of the reduced gap cross-section. thus we see again that the final acoustic performance of the loudspeaker is a function of the mechanical tolerances permissible between controlled moving parts."

There have been several other loudspeakers that have incorporated dual spiders for supporting their diaphragms. the difficulty with these dual spiders is that their manufacturer is unable to adjust the linearity of the loudspeakers' response after manufacture thereof. The two externally placed spiders are disposed in a fixed position. It would be ideal to provide an adjustable spider for loudspeakers that can reduce the bias in the response thereof.

SUMMARY OF THE INVENTION

In view of the foregoing factors and conditions characteristic of the prior art, it is a primary object of the present invention to provide an adjustable internal spider for use in combination with a loudspeaker having an external spider mechanically coupling its frame to the base of its diaphragm.

It is another object of the present invention to provide a dual spider arrangement that not only eliminates lateral movement, but also provides more truly axial or linear movement by having a larger lateral separation between the dual spiders.

It is still another object of the present invention to provide an internal spider that functions as a dust cap thereby reducing the number of components required in the loudspeaker.

It is yet still another object of the present invention to provide a clamp system that allows lateral spider adjustment in order to correct a faulty assembly that is incapable of true axial motion without remanufacturing.

In accordance with an embodiment of the present invention, an internal stabilizing spider-dust cap for use in combination with a loudspeaker that has an external centering spider and a surround mechanically coupling the conically shaped diaphragm of the loudspeaker to the frame thereof has been described. The loudspeaker includes a pole piece, a gap plate, a pole plate of iron and a ring-shaped magnet which are separated by a cylindrical voice coil member and a voice coil, which is disposed about the voice coil member, and which provides a magnetic gap for the voice coil. The centering spider aligns the voice coil within the magnetic gap. The stabilizing spider is mechanically coupled to the internal sidewall of the conically shaped diaphragm and to a rod which is disposed perpendicularly into the pole piece. The center of the stabilizing spider is mechanically clamped to the rod by a mounting plate device which is secured in place by a set screw in one embodiment so that it may be raised and lowered in order to modify the compliance linearity of the existing suspension. A lateral adjustment may also be provided to increase effective excursion and to correct for faulty assembly.

The features of the present invention which are believed to be novel are set forth with particularity in the appended claims.

Other objects and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a first loudspeaker having a dual spider which has been constructed in accordance with the principles of the present invention.

FIG. 2 is a partial cross-sectional view of the loudspeaker of FIG. 1 taken along the line 2—2 of FIG. 1.

FIG. 6 is a cross-sectional side view of a first clamping apparatus for an internal stabilizing spider for the loudspeaker of FIG. 1.

FIG. 7 is a cross-sectional side view of a second clamping apparatus for an internal stabilizing spider for the loudspeaker of FIG. 1.

FIG. 8 is a side cross-sectional view of a second loudspeaker having a dual spider which has been constructed in accordance with the principles of the present invention.

FIG. 9 is a side cross-sectional view of the loudspeaker having a dual spider which has been constructed in accordance with the principles of the present invention.

DESCRIPTION OF THE PREFERRED EMBODIMENT

Figure 3:
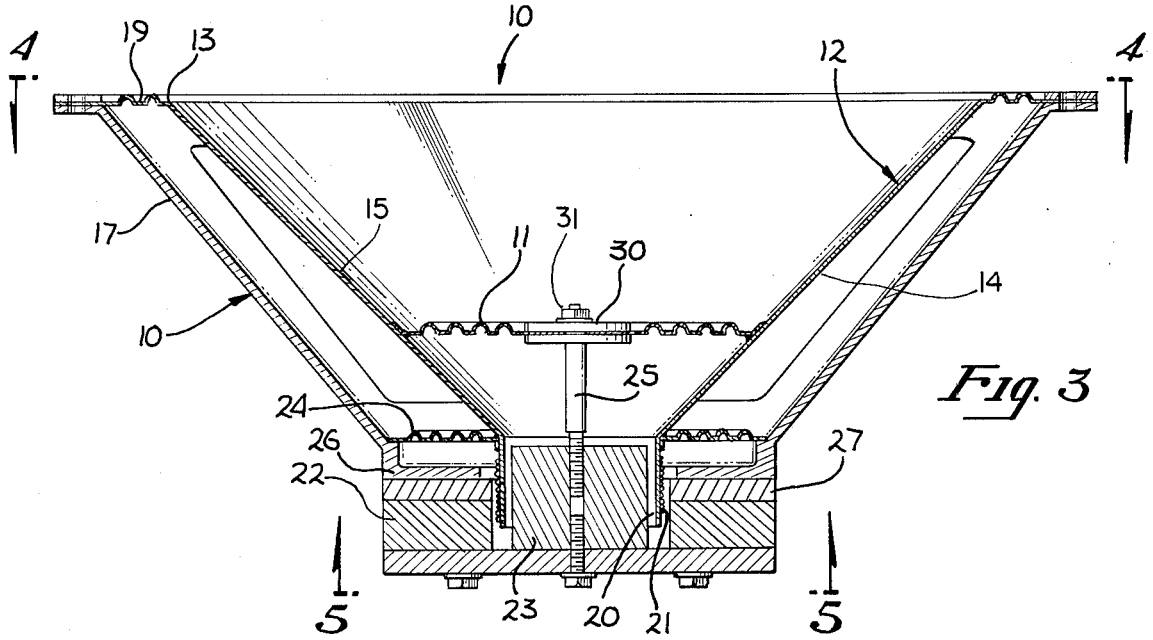
FIG. 3 is a side cross-sectional view of the loudspeaker of FIG. 1 taken along line 3—3 of FIG. 2.

The present invention can best be understood by reference to a description of its preferred embodiment and to the showings in the drawing. The invention is an improvement for use in combination with a loudspeaker 10 shown in FIG. 1 to provide an adjustable stabilizing spider 11. The loudspeaker 10 includes a conically shaped diaphragm 12 having a front peripheral edge 13, an external sidewall 14, an internal sidewall 15 and a base peripheral edge 16 and a frame 17 having a conically shaped portion adapted to receive the diaphragm 12 and a front plate 27. The loudspeaker 10 also includes a surround 19 which mechanically couples the front peripheral edge 13 of the diaphragm 12 to the frame 17.

Referring now to FIG. 2 the loudspeaker 10 further includes a cylindrically shaped voice coil member 20 which is mechanically coupled to the base peripheral edge 16 of the diaphragm 12, a voice coil 21 disposed about the voice coil member 20, a ring-shaped magnet 22, which is disposed about the voice coil 21 and which is mechanically coupled to the back plate 18, and a cylindrical iron pole piece 23 which is disposed within the voice coil member 20 and which is also mechanically coupled to the back plate 18. The ring-shaped magnet 22 and the pole piece 23 create a magnetic gap across the voice coil 21.

Still referring to FIG. 2 the loudspeaker 10 still further includes a centering spider 24 which mechanically couples the base peripheral edge 16 of the diaphragm 12 to the base portion 26 of the frame 17. The centering spider 24 centers the voice coil 21 within the magnetic gap.

Figure 4:
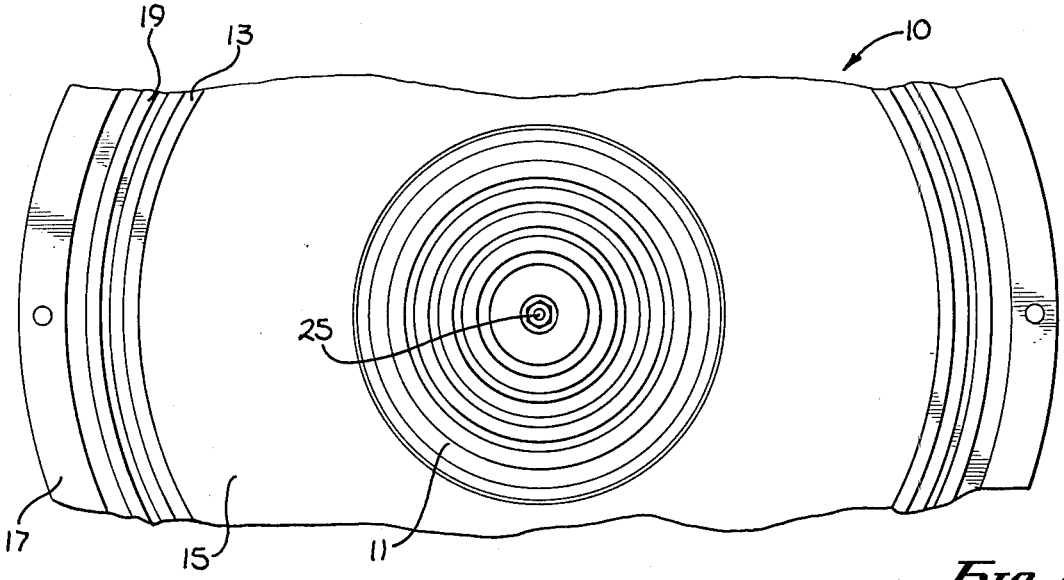
FIG. 4 is a partial top plan view of the loudspeaker of FIG. 1.

Referring now to FIG. 3 in conjunction with FIG. 4 the stabilizing spider 11 is mechanically coupled to the internal sidewall 15 of the diaphragm 12 to a rod 25 which is disposed perpendicular to the pole piece 23 at the center thereof.

Figure 5:
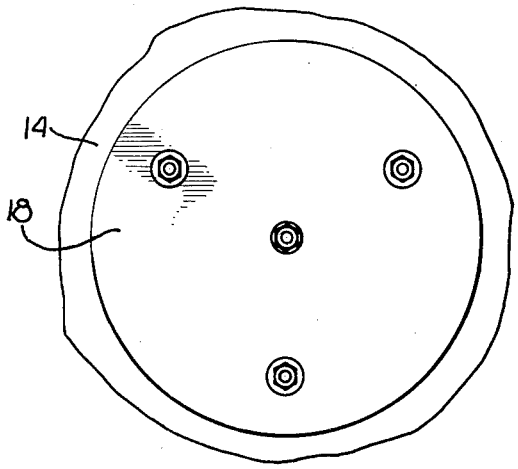
FIG. 5 is a partial bottom plan view of the loudspeaker of FIG. 1.

Referring briefly to FIG. 5 one may view a back plate 18 of the loudspeaker 10.

Referring again to FIG. 3 the stabilizing spider 11 is mechanically coupled to the rod by a mounting device 30 which is adapted to travel up and down the rod 12 and which is secured in place by a set screw 31 to provide adjustability to the stabilizing spider. In operation the stabilizing spider 11 provides a more truly axial movement while eliminating lateral movement than the dual spider taught by Abraham B. Cohen in his articles. The stabilizing spider 11 also functions as a dust cap.

Referring now to FIG. 6 a first coupling device 60 for mechanically coupling the stabilizing spider 11 to the rod 25 includes a top member 61, which has a cylindrical collar 62 coupled in axial alignment therewith, and a bottom member 63 between which the stabilizing spider 11 is placed and which are joined by a pair of set screws 64. The stabilizing spider 11 may be radially adjusted by loosening the set screws 64 and repositioning the stabilizing spider 11. The coupling device 60 travels slidably along the rod 25 so that the stabilizing spider 11 may be axially adjusted and is then secured by a third set screw 66 which secures the cylindrical collar 62 of the top member 61 to the rod 25.

Referring now to FIG. 7 a second coupling device 70 for mechanically coupling the stabilizing spider 11 to a rod 71 of a second type having a threaded portion 72. The second coupling device includes a top piece 73 and a bottom piece 73 which the stabilizing spider 11 is placed. The second coupling device 70 is adapted to be mechanically coupled to the threaded portion 72 of the rod 71 so that the stabilizing spider 11 may be adjusted axially along the rod 71.

Referring now to FIG. 8 the stabilizing spider 11 may be mechanically coupled to a rod 81 which is secured to a support member 82 which is attached to oppositely disposed peripheral edges of the frame 17 of the loudspeaker 10. The stabilizing spider 11 is mechanically coupled to the rod 81 by the second coupling device 70.

Referring now to FIG. 9 the stabilizing spider 11 may be mechanically coupled to a mass 90 which has a central hole 91 therein and slideably coupled to the rod 25 so that the stabilizing spider 11 is axially aligned and centered. The mass 90 provides additional mass which may be adjusted in addition to the compliance of the stabilizing spider 11 in order to alter the mechanical-acoustical system of the loudspeaker 10. There is also a cylindrical Teflon bearing 92 to provide slideability for the mass 90 disposed within the hole 91 thereof.

Furthermore, it should be noted that the schematics of the device have not been drawn to scale and that distances of and between the figures are not to be considered significant.

Accordingly, it is intended that the foregoing disclosure and showings made in the drawing shall be considered as illustrations of the principles of the present invention.

What is claimed is:

1. A stabilizing spider arrangement for use in combination with a loudspeaker that includes:

a. a conically shaped diaphragm having a front peripheral edge, an external sidewall, an internal sidewall and a base peripheral edge;

b. a cylindrically shaped voice coil member which is mechanically coupled to the diaphragm adjacent to its base peripheral edge;

c. a voice coil mechanically coupled to the voice coil member;

d. a ring-shaped magnet disposed about the voice coil member;

e. a pole piece disposed within the voice coil member with the ring-shaped magnet and the pole piece creating a magnetic gap therebetween;

f. a frame that includes a conically shaped portion with an internal sidewall which receives the conically shaped diaphragm and a base portion which receives the ring-shaped magnet, the voice coil member and the pole piece; and g. a centering spider which mechanically couples the base portion of the frame to the base peripheral edge of the diaphragm, said stabilizing spider arrangement comprising:

i. a rod which is mechanically coupled to the pole and which is disposed perpendicular thereto at its center;

ii. a stabilizing spider which mechanically couples the internal sidewall of the diaphragm to said rod;

iii. a coupling device which has a top member, which has a cylindrical collar coupled in axial alignment therewith, and a bottom member between which said stabilizing spider is placed;

iv. a pair of set screws mechanically coupling said top member and said bottom member together with said stabilizing spider being disposed therebetween so that said stabilizing spider may be radially centered; and v. a third set screw which secures said collar of said top member so that said top member and said bottom member may be secured in place along the axis of said rod by said third set screw.

2. A stabilizing spider arrangement for use in combination with a. a conically shaped diaphragm having a front peripheral edge, an external sidewall, an internal sidewall and a base peripheral edge;

b. a cylindrically shaped voice coil member which is mechanically coupled to the diaphragm adjacent to its peripheral edge;

c. a voice coil which is mechanically coupled to the voice coil member;

d. a ring-shaped magnet which is disposed about the voice coil member;

e. a pole piece which is disposed within the voice coil member with the ring-shaped magnet and the pole piece creating a magnetic gap therebetween;

f. a frame that includes a conically shaped portion with an internal sidewall which receives the conically-shaped diaphragm and a base portion which receives the ring-shaped magnet, the voice coil member and the pole piece; and g. a centering spider which mechanically couples the base portion of the frame to the base peripheral edge of the diaphragm, said stabilizing spider arrangement comprising:

i. a stabilizing spider which is mechanically coupled to the internal sidewall of the diaphragm;

ii. a mass which is mechanically coupled to said stabilizing spider at its center;

iii. a rod which is mechanically coupled to the pole piece and which is disposed perpendicularly thereto at its center; and iv. a cylindrical Teflon bearing which may be inserted into a hole in said mass so that said mass may slidably engage said rod in order to provide an axial centering of said stabilizing spider arrangement.

* * * * *